US009493977B2

(12) United States Patent
Svenson

(10) Patent No.: US 9,493,977 B2
(45) Date of Patent: Nov. 15, 2016

(54) POST FOR A FOLDING DOOR

(71) Applicant: Julian Michael Svenson, Cornwall (CA)

(72) Inventor: Julian Michael Svenson, Cornwall (CA)

(73) Assignee: Dynamic Closures Corporation, Long Sault, Ontario (CA)

( * ) Notice: Subject to any disclaimer, the term of this patent is extended or adjusted under 35 U.S.C. 154(b) by 0 days.

(21) Appl. No.: 14/544,691

(22) Filed: Feb. 3, 2015

(65) Prior Publication Data

US 2016/0017652 A1 Jan. 21, 2016

(30) Foreign Application Priority Data

Jul. 21, 2014 (CA) ..... 2857151

(51) Int. Cl.
*E06B 1/18* (2006.01)
*E06B 3/48* (2006.01)
*E06B 1/52* (2006.01)

(52) U.S. Cl.
CPC .. *E06B 3/48* (2013.01); *E06B 1/52* (2013.01)

(58) Field of Classification Search
CPC ..... E06B 1/18; E06B 1/30; E06B 3/26336; E04B 2/7824; E04B 2/7836; E04B 2/7809; E04C 2003/0465; E04C 3/07; E04C 3/28; E04C 3/32
See application file for complete search history.

(56) References Cited

U.S. PATENT DOCUMENTS

| | | | | | |
|---|---|---|---|---|---|
| 2,032,922 | A * | 3/1936 | Driver | 52/766 |
| 3,728,837 | A * | 4/1973 | Kiefer, Jr. | 52/844 |
| 4,580,380 | A * | 4/1986 | Ballard | 52/309.9 |
| 4,944,169 | A | 7/1990 | Labelle | |
| 5,095,678 | A * | 3/1992 | Murphy | 52/844 |
| 5,417,023 | A * | 5/1995 | Mandish | 52/348 |
| 5,713,176 | A * | 2/1998 | Hunt | 52/847 |
| 5,802,800 | A * | 9/1998 | Meyers | 52/847 |
| 5,864,998 | A * | 2/1999 | Loomer | 52/271 |
| 6,094,881 | A * | 8/2000 | Lockwood | 52/845 |
| 2003/0024179 | A1* | 2/2003 | Cates et al. | 52/204.1 |
| 2006/0253057 | A1* | 11/2006 | Qi et al. | 602/23 |
| 2007/0266671 | A1* | 11/2007 | Chromy | 52/731.3 |

FOREIGN PATENT DOCUMENTS

| | | | |
|---|---|---|---|
| FR | 958763 | * | 3/1950 |
| FR | 1377860 | * | 11/1964 |
| FR | 1578556 | * | 12/1968 |
| WO | WO 2013154416 A1 | * | 10/2013 |

* cited by examiner

*Primary Examiner* — Christine T Cajilig
(74) *Attorney, Agent, or Firm* — George A. Seaby

(57) ABSTRACT

A locking post for a folding door having two face panels and two end panels, the panels extending the length of the post. A plurality of relatively short, spacers are in the post, including a spacer at each end of the post. First fasteners fasten one face panel to each spacer on one side of each spacer and fasten the other face panel to each spacer on the side of each spacer opposite the one side, the face panels parallel and aligned. Second fastens detachably fasten one end panel to both face panels along one side of the face panels and detachably fasten the other end panel to both face panels on the other side of the face panels, the end panels parallel, the face panels and end panels together providing a tubular enclosure for the spacers.

10 Claims, 5 Drawing Sheets

POST FOR A FOLDING DOOR

BACKGROUND OF THE INVENTION

1. Technical Field

The application relates to a post for a folding door and more particularly, a locking post.

2. Background Art

Locking posts presently used in folding doors are usually expensive to construct. They are typically of unitary, tubular construction so is difficult to mount lock mechanisms into the post and to adjust and/or service the lock mechanisms once installed. The post usually has several items projecting from the surface such as handles and portions of the locking mechanism such as lock cylinders which can be a hindrance, which can be damaged or broken, and which may mar the appearance of the door.

SUMMARY OF THE INVENTION

In one aspect, there is provided a locking post for a folding door having: first and second separate face panels; first and second separate end panels; a plurality of spaced-apart spacers including a spacer at least near each end of the post, the spacers having opposed parallel sides; the first face panel attached to the spacers to be on one side of the spacers, the second face panel attached to the spacers to be on the other side of the spacers, the face panels parallel and aligned; the first end panel detachably attached to the two face panels at one side of the face panels, the second end panel detachably attached to the two face panels at their other side, the end panels parallel and aligned; the face panels and end panels together providing a tubular enclosure for the spacers.

In another aspect, there is provided a locking post for a folding door having: two separate face panels, each face panel having two side edges extending along parallel axes; two separate end panels, each end panel having two side edges extending along parallel axes; a plurality of spaced-apart spacers including a spacer at least near each end of the post, the spacers having opposed, parallel sides; a first fastener fastening each face panel to each spacer, one of the face panels extending on one side of each spacer, the other of the face panels extending on the opposed side of each spacer, the face panels parallel and aligned; one side of one end panel detachably connected to one side of one face panel and second fasteners detachably fasten the other side of the one end panel to one side of the other face panel; one side of the other end panel detachably connected to the other side of the one face panel and second fasteners detachably fasten the other side of the other end panel to the other side of the other face panel, the end panels parallel.

In a further aspect, there is provided a method of making a locking post for a folding door comprising the steps of: providing a first face panel; mounting one side of spacers on the first face panel at spaced apart locations on the first face panel including at least near the ends of the panel; mounting at least one locking mechanism on one or both of the first face panel and the spacers; mounting a second face panel on the opposed side of the spacers, the second face panel parallel to the first face panel and aligned therewith; and detachably mounting a first end panel between the two face panels on one side of the face panels and detachably mounting a second end panel between the two face panels on the other side of the face panels.

DESCRIPTION OF SEVERAL VIEWS OF THE DRAWINGS

Reference is now made to the accompanying figures in which.

DETAILED DESCRIPTION

Figure 1:
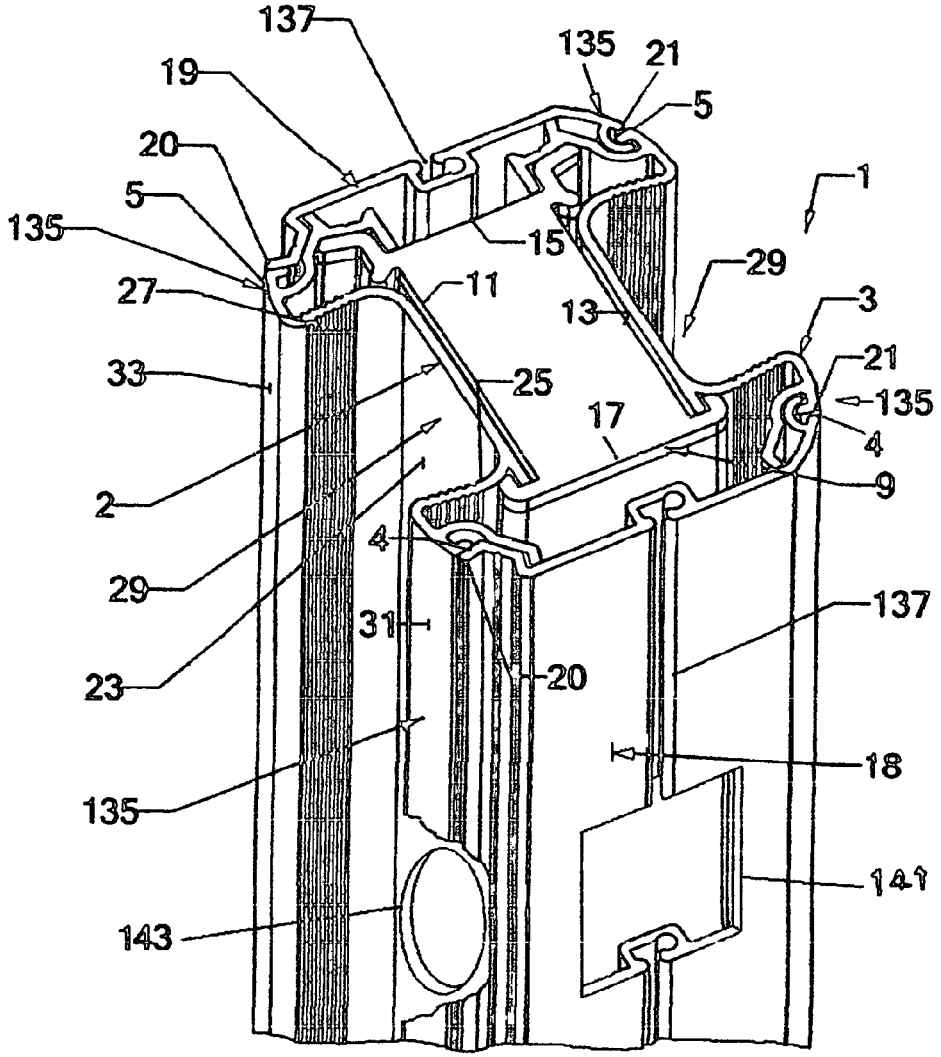
FIG. 1 is a schematic perspective view of a section of a post in accordance with a particular embodiment.

A locking post according to particular embodiment is constructed of four, separate, elongate, panels extending the length of the post, the panels mounted directly and indirectly on spaced-apart blocks or spacers. The panels form a tubular enclosure for the spacers. Two of the panels are opposed on the post and face the public on either side of the post when the post is incorporated in a folding door closure. The panels are face panels. The face panels are directly mounted on the spacers which spacers mount and hold the panels apart a desired distance and contribute to supporting various parts of a door locking mechanism. The elements employed in the locking post such as various locking mechanisms and a support trolley are mounted on at least some of the spacers and possibly the face panels. The open sides of the post are closed by the end panels which are mounted on the face panels. The door locking mechanism has a latch that projects out one of the end panels.

In a particular embodiment, the post has two, separate, elongate face panels and two, separate, elongate, end panels. The post includes a plurality of relatively short, spaced-apart spacers including a spacer at each end of the post. One face panel is mounted on each spacer to be on one side of the spacer and the other face panel is mounted on each spacer to be on the other opposite side of each spacer with the face panels parallel. Each face panel is fastened to each spacer with a fastener. One end panel is detachably connected along one side to one side of one of the face panels and along the other side to one side of the other face panel. The other end panel is detachably connected along one side to the other side of the one face panel and along the other side to the other side of the other face panel.

In a particular embodiment, the post is constructed by laying down one of the face panels on a work surface and attaching the various spacers to the inside of the panel and then attaching at least some of the locking mechanisms to the panel and spacers as required. Since the post is wide open it is easy to mount the required parts on the panel. The opposing face panel is attached to the spacers next opposing the first face panel, and the installation of the locking mechanisms and any other mechanical elements can be completed if needed, incorporating the second face panel to support some of the locking mechanisms. Any remaining installation required is still fairly simple since the sides of the post are still open. When the installation of the parts required in the interior is completed, the end panels are installed to close and complete the post. The end panels are detachable so the lock mechanisms can be easily serviced by merely removing one or both end panels.

In a particular embodiment, the face panels of the completed post are each shaped over their length to have a depressed flat central area flanked by side walls over the length of the post. A person can grip a side wall on the post, on either side of the post from either side of the depression, to open or close the door. Locking features associated with the post, such as a cylinder or a lock operating handle can also be located in the depression so they are not damaged or interfere with anyone passing by.

An exemplary embodiment of the locking post is described herein. It is however understood that the configurations of the various elements may vary.

Figure 2:
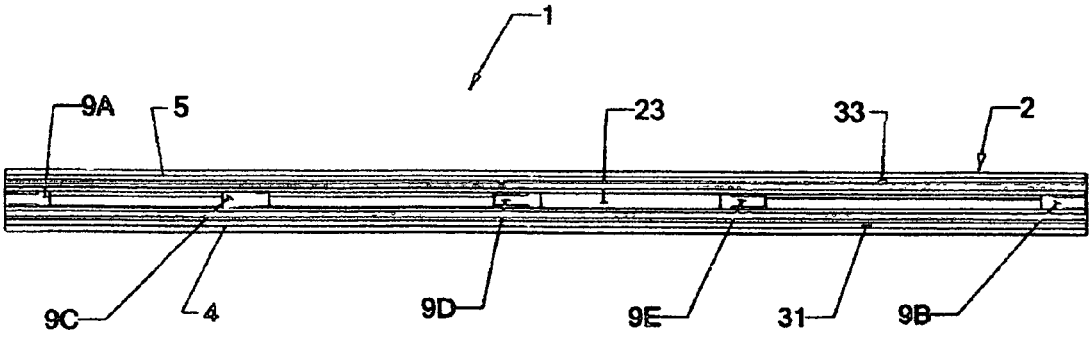
FIG. 2 is a schematic view of a face panel with spacers of the post of FIG. 1.
Figure 3:
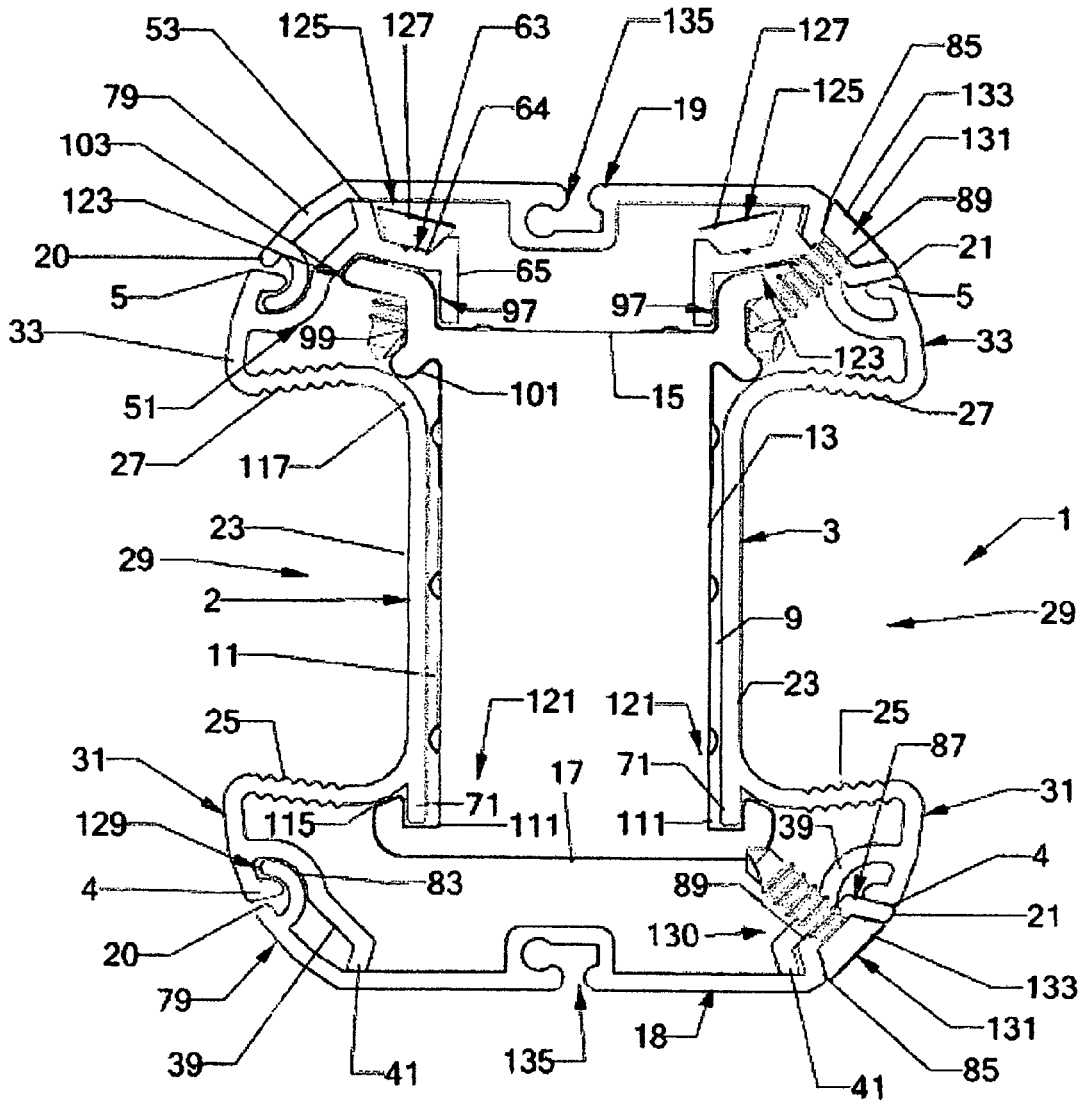
FIG. 3 is a schematic cross-sectional view of the post of FIG. 1.

Referring to FIGS. 1-3, a locking post 1 for a folding door in accordance with a particular embodiment is shown, including a first face panel 2 and a second face panel 3. Each face pane 12, 3 has side edges 4 and 5. The side edges 4, 5 extend along parallel axes. The face panels 2,3 are separate entities, identical, and extend the length of the post. The face panels 2, 3 on the post 1 are parallel and separated a desired distance from each other by spaced-apart spacers 9. FIG. 2 shows the first face panel 2 with spacers 9 mounted thereon. There is an end spacer 9A, 9B at each end of the face panel 2 and three intermediate spacers 9C, 9D and 9E in-between the end spacers 9A, 9B. More or less intermediate spacers 9 could be used. The spacers 9 are roughly rectangular in shape and normally have wide sides 11, 13 and relatively narrow ends 15, 17; alternately they could have a length greater than their width. The first and second face panels 2, 3 are each fastened to the end spacers 9A, 9B and to each of the other spacers in between, as will be described.

Referring back to FIG. 1, the post 1 has first and second end panels 18, 19 to close the sides of the post between the face panels 2, 3. The end panels 18, 19 are separate entities, identical, and extend the length of the post. Each end panel 18, 19 has side edges 20, 21 extending along parallel axes. The end panels 18, 19 are fastened to the face panels 2, 3, as will be described, to have their side edges 20, 21 adjacent to the side edges 4, 5 of the face panels 2, 3.

Figure 4:
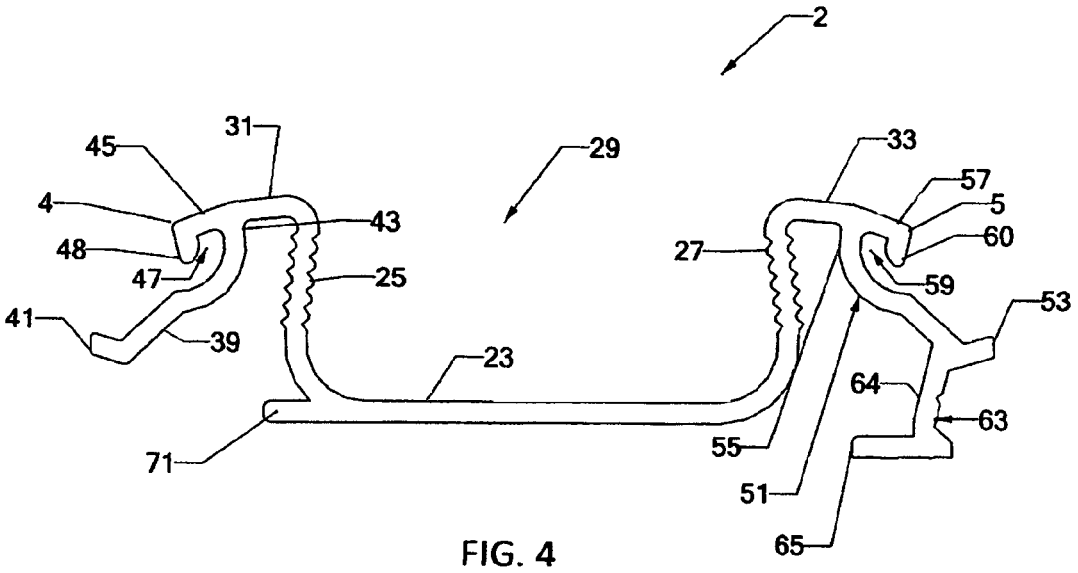
FIG. 4 is an end view of the face panel of FIG. 3.

Since the first and second face panels 2, 3 are identical, only the first face panel 2 will be described in detail. The first face panel 2, as shown in FIGS. 3 and 4, has a central, flat section 23 extending along the length of the post with side walls 25, 27 extending transversely from the sides of the central section 23. The central section 23 and the side walls 25, 27 define a wide, relatively deep, groove 29 in the face panel 2 extending along the length of the panel.

The face panel 2 has side sections 31, 33 extending laterally away from the outer edges of the side walls 25, 27. The side sections 31, 33 curve toward the second face panel 3. The first side section 31 terminates in the first side edge 4 and the second side section 33 terminates in the second side edge 5.

The first side section 31 has a first support arm 39 with a curved portion 43 extending from the side section 31 spaced slightly back of the side edge 4, and curved to extend away from the side wall 25. The first support arm 39 has an end portion extending from its curved portion 43 away from the side wall 25 and terminating in a free edge 41. The side section 31 has an end portion 45 extending beyond the curved portion 43 and including the side edge 4. The curved portion 43 of the support arm 39 forms, with the end portion 45 of the side section 31, a socket 47. The end portion 45 of the side section 31 is bent toward the flat section 23 a short distance to form a hook 48, closing part of the mouth of the socket 47. The socket 47 is used to connect the side section 31 of the face panel 2 to one side section of the first end panel 18, as will be described.

The second side section 33 has a second support arm 51 with a curved portion 55 extending from the side section 33 spaced slightly back from the side edge 5, and curved to extend away from the side wall 27. The second support arm 51 has an intermediate portion extending from its curved portion 55 away from the side wall 27 and terminating in a free edge 53. The side section 33 has an end portion 57 extending beyond the curved portion 55 and including the side edge 5. The curved portion 55 of the second support arm 51 forms, with the end portion 57 of the side section 33, a socket 59. The end portion 57 of the side section 33 is bent toward the flat section 23 a short distance to form a hook 60, closing part of the mouth of the socket 59. The socket 59 is used to connect the side section 33 of the face panel 2 to one side of the second end panel 19, as will be described.

The second support arm 51 also includes a branch support arm 63, having an initial straight section 64 extending inwardly from the end portion of the support arm 51, generally in the same direction as the wall 27 and then bent to have its end section 65 extend generally toward the other side of the panel 2. The branch support arm 63 is used for connecting the second side section 33 of the face panel 2 to one end 15 of the spacer 9, as will be described. The central section 23 of the first face panel 2 has a short, extension 71 extending laterally therefrom past the sidewall 25, in alignment with the face panel 2. The extension 71 is used to connect the first face panel 2 to the spacer 9 near its other end 17, as will be described.

Figure 5:
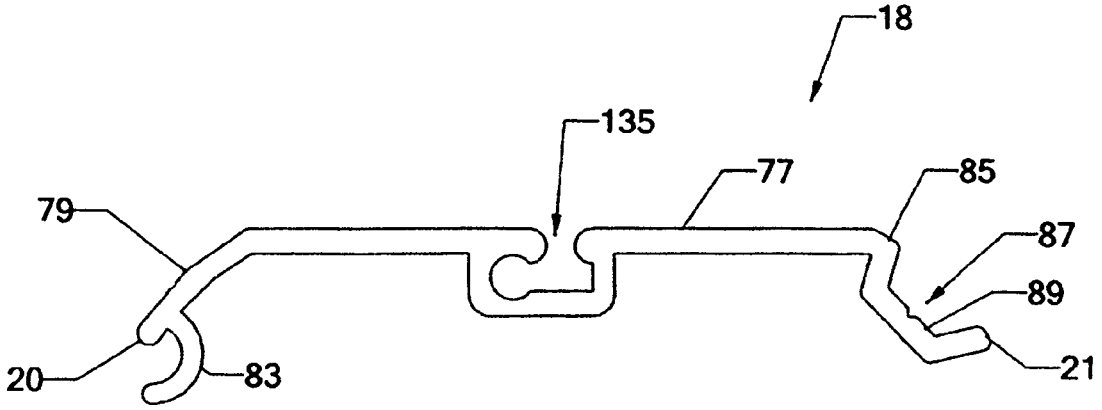
FIG. 5 is an end view of an end panel of the post of FIG. 3.

The end panels 18, 19 being identical, only one will be described in detail. The first end panel 18, as shown in FIGS. 3 and 5, has a straight, wide, central section 77 with a first, relatively short, end section 79 curving inwardly away from one side of the central section 77. The end section 79 terminates in the side edge 20 of the end panel 18. A short, hook arm 83 extends inwardly from the end section 79, spaced back from the side edge 20 and curving back toward the side edge 20. The hook arm 83 is used to connect the end section 79 of the end panel 18 to the first end section 31 of the face panel 2, with the side edge 20 of the end panel 18 adjacent to the side edge 4 of the face panel 2 and both edges 4, 20 extending along parallel axes, as will be described. A second, relatively short, end section 85 bends away from the other side of the central section 77 of the first end panel 18. The end section 85 bends inwardly and then slightly outwardly forming a shallow, outwardly facing groove 87 with a flat bottom 89, which groove extends the length of the panel 18. The end section 85 ends in the side edge 21. The bottom 89 of the groove 87 is shaped and sized to sit flat on the support arm 39 of the other face panel 3 on the other side of the spacer 9. Groove 89 is used to connect the end section 85 of the first end panel 18 to the end section 31 of the second face panel 3 as will be described. After the connection is made, the side edge 21 of the first end panel 18 is to the side edge 4 of the second face panel 3, with both edges 21, 4 extending along parallel axes.

Figure 6:
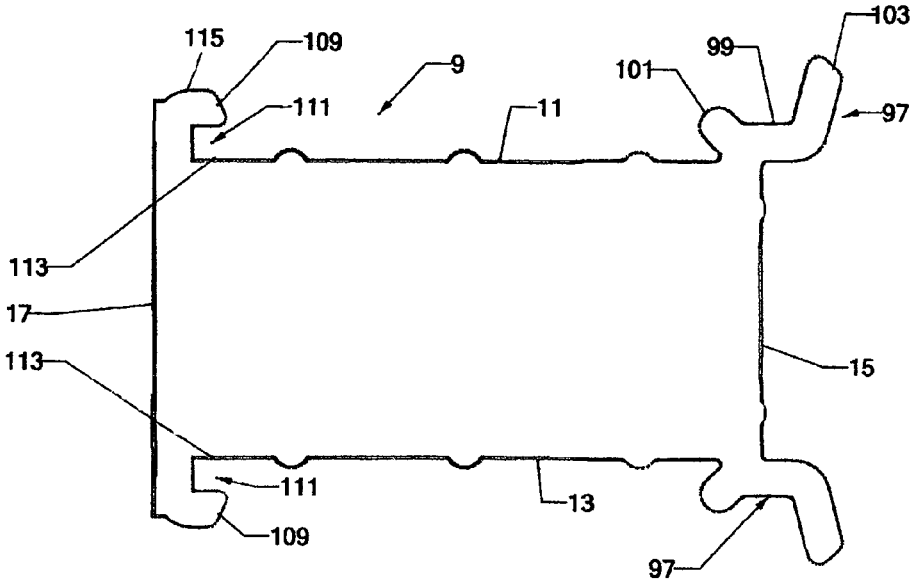
FIG. 6 is a schematic end view of a spacer in the post of FIG. 3.
Figure 7:
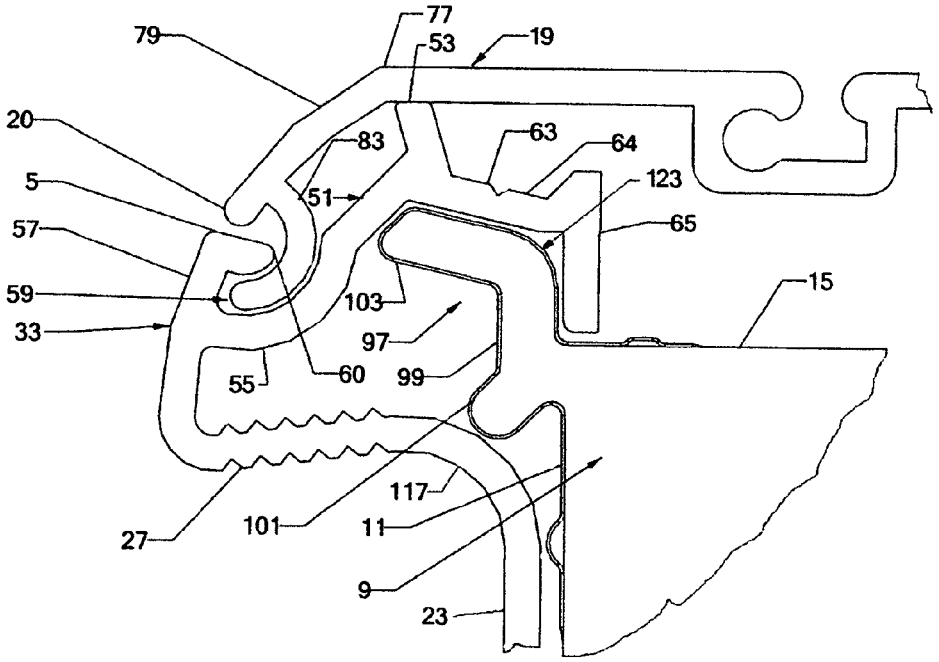
FIG. 7 is a detail view of a corner of the post of FIG. 3.

The spacers 9 are provided with means to support and hold the face panels 2, 3 in place. A first end 15 of each spacer 9 has an integral double flange 97 extending outwardly from each corner of the end 15 as shown in FIGS. 3 and 6. The flange 97 has a short base 99 section attached to the main body of the spacer 9 that is generally parallel with sides 11, 13 of the spacer 9. The flange 97 includes a short flange section 101 extending out from one end of the base section 99 and angled toward the opposite end 17 of the spacer and a longer flange section 103 extending out from the other end of the base section 99 and away from the end 15 of the spacer. The flanges 97 are used for connecting the face panels 2, 3 to the spacer 9. Near the second end 17 of the spacer 9, the spacer is slightly widened forming an angled shoulder 109 on each side 11, 13 of the spacer. A slot 111 extends into the shoulder 109 with one wall 113 of the slot 111 forming an extension of the sides 11, 13 of the spacer. The short outer wall 115 formed by the slot 111 has its free end, forming part of the shoulder 109, angled outwardly and toward the opposite end 15 of the spacer 9. The slot 111 on side 11 is used to connect the first face panel 2 to the spacer 9 and the slot 111 on side 13 connects the second face panel 3 to the spacer 9.

Both face panels 2, 3 are mounted on the spacers 9 the same way so only one mounting of face panel 2 will be described. The one end 17 of a spacer 9 slides onto the face panel 2 with the extension 71 on the face panel 2 sliding into the slot 111 on the spacer 9 to form a first connection 121. The short wall 115 on the spacer slides snugly into the gap between the extension 71 and the side wall 25 on the face panel 2 to strengthen the first connection 121. The first connection 121 helps retain one side of the face panel 2 against the side 11 of the spacer and prevents the face panel 2 from moving toward the end 17 of the spacer.

At the same time, at the other end 15 of the spacer 9, the flange 97 slides into the space between the side wall 27 of the face panel 2 and the straight section 64 of the branch support arm 63 and lies adjacent the end section 65 of the branch support arm 63 to form a second connection 123. The short flange section 101 of the spacer abuts the face panel 2 at the corner 117 formed between the side wall 27 and the central area 23 of the groove 29. The long flange section 103 of the spacer abuts the support arm 51 on the face panel 2 while it lies against the straight section 64 of the branch support arm 63. The base 99 of the flange 97 of the spacer lies against the outer section 65 of the branch support arm 63.

When both ends 15, 17 of the spacer 9 are slid on the face panel 2, the central area 23 of the groove 29 on the face panel 2 lies against the side 11 of the spacer. The first and second connections 121, 123 retain the face panel 2 against the side, 11 of the spacer. When viewing FIG. 3, the first face panel 2 is prevented from moving in all four directions-up, down, right or left, relative to the spacer by the first and second connections 121, 123. All the rest of the spacers 9 are similarly mounted on the first face panel 2.

Once each spacer 9 and the first face panel 2 have been slidingly interconnected by the first and second connections 121, 123, and the first spacer has been located where it is required longitudinally on the panel 2, a first fastener 125 is provided to fasten the panel 2 and spacer 9 together so they cannot slide relative to each other. In the embodiment shown, the first fastener 125 includes a screw 127, such as a metal screw inserted through the branch support arm 63 where it abuts the flange section 103, and through the flange section 103 to lock the face panel 2 to the spacer 9; any other adequate type of fastener can alternately be used, and the location of the fastener can vary. The remaining spacers 9 can be similarly fastened in place after mounting in the required position on the first face panel 2.

Once all the spacers 9 are securely mounted on first face panel 2 any internal lock mechanism(s) employed by the post are mounted on the spacers and the panel. Once all the internal lock mechanisms have been installed, the second face panel 3 is mounted in the same manner, as the first face panel 2 was mounted, to each spacer 9 on the other side 13 of the spacers. The second face panel 3 is connected by another set of first and second connections 121, 123 to the spacers and retained in place by another set of fasteners 125, such as for example screw fasteners 127, one for each spacer. The face panels 2, 3 overlie the spacers 9 and sandwich the spacers between them. The mounted face panels 2, 3 are parallel and aligned with each other. Any external lock mechanism(s) can now be added to the post.

Figure 8:
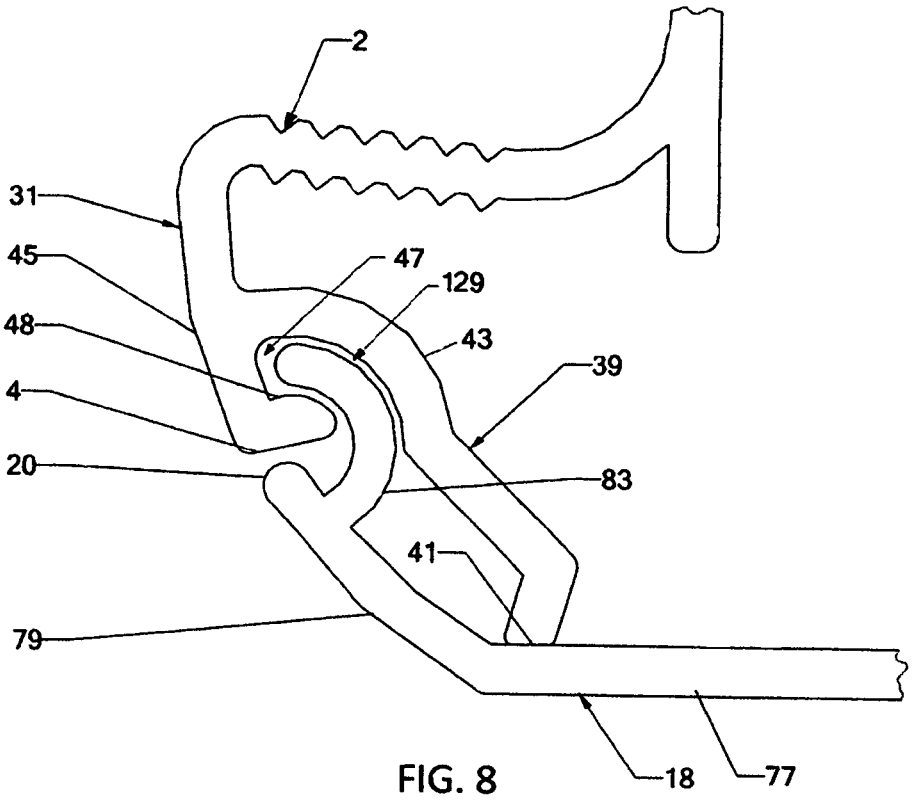
FIG. 8 is another detail view of another corner of the post of FIG. 3.
Figure 9:
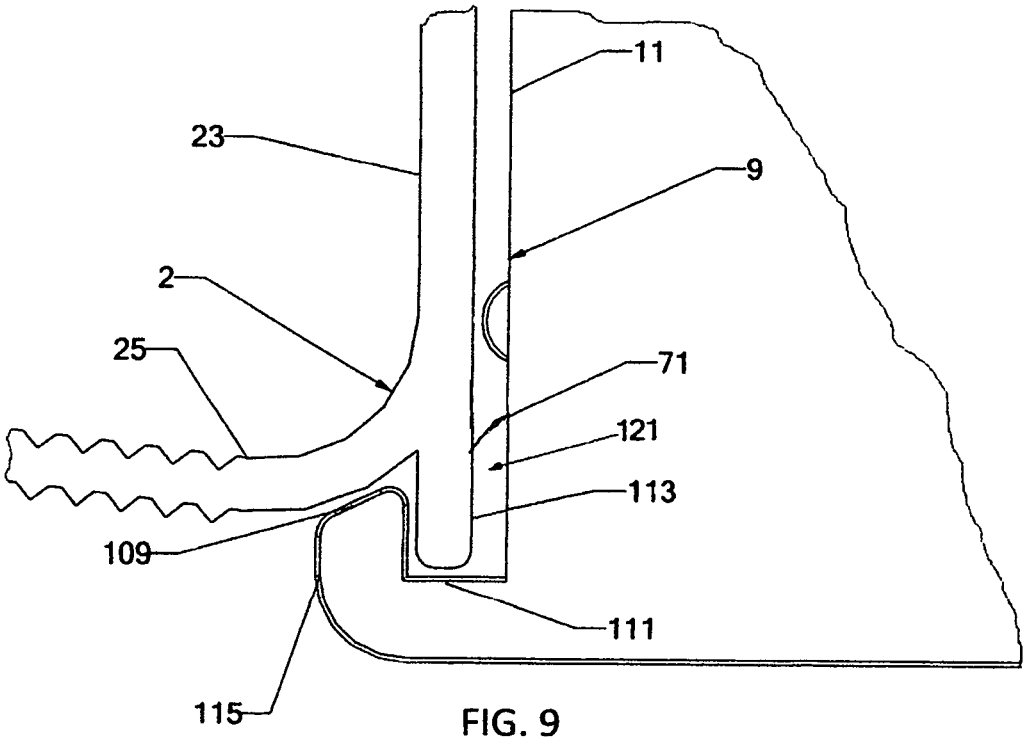
FIG. 9 is a detail view of a connection between a spacer and a face panel.

The end panels are mounted to the face panels to close the open sides of the post. The first end panel 18 is mounted with the side section 79 that has the hook arm 83, connected to either face panel 2, 3. Which face panel 2, 3 the end panel 18 is connected to will depend on which face panel is facing away from the area to be enclosed by the closure the post is on. If the first face panel 2 is facing away, the end section 79 of end panel 18 is connected by its hook arm 83 to the side section 31 of the first face panel 2. The hook arm 83 is inserted into the socket 47 on the panel 2 to form a third connection 129, placing one side edge 20 of the end panel 18 adjacent to one side edge 4 of the face panel 2, with the side edges 20, 4 extending along parallel axes as shown in FIGS. 3 and 8. The hook 48 in socket 47 cooperates with the hook arm 83 to pivotally connect the first end panel 18 to the first face panel 2.

The end panel 18 is then pivoted about the third connection 129 to place its other end, and particularly its arm section 87, on the support arm 39 on the second face panel 3. The groove 89 on the arm section 87 fits snugly between the outer end of the support arm 39 and the side edge 4 on the face panel 3 forming a fourth connection 130. As the end panel 18 comes into contact with the second face panel 3 it also comes to rest on the free edges 41 of the first support arms 39 on both face panels 2, 3 to help locate and support the end panel 18. When the end panel 18 is positioned on the support arm 39 on the second face panel 3, its other side edge 21 is adjacent and parallel to the side edge 4 of the face panel 3. Second fasteners 131 are then applied to detachably join the arm section 87 on the end panel 18 to the support arm 39. The fastener 131 is also preferably a metal screw 133, but any other adequate type of fastener can alternately be used, and the location of the fastener can vary. The second fasteners 131 detachably fastens the end panel 18 to the face panel 3, the screws 133 sitting in the groove 89. Both end panels 18, 19 are mounted similarly between the face panels 2, 3. The fastener 131 used with each end panel 18, 19 can be applied between the spacers 9 located between the face panels 2, 3 as needed or at the spacer locations.

The mounted end panel 19 covers the fasteners 125 connecting the face panels 2, 3 to the spacers 9. The fasteners 131 joining the end panels 18, 19 to the second face panel 3 are visible and accessible. Either end panel 18, 19 can be removed by removing the fasteners 131 and pivoting the panel out of the socket 47 or 59 to provide access to the interior of the post to service the lock mechanism(s) if needed. The fasteners 131 holding the end panels 18, 19 are not accessible however to anyone outside the area closed by the closure since the fasteners 131 are on the inside of the area.

The post has been described with the first face panel 2 facing away from the area to be enclosed by the closure the post is on, with the end panels 18, 19 fastened to the second face panel 3 which faces into the area being closed and is on the inside of the enclosure. If however face panel 2 faces into the area to be enclosed, the end panels 18, 19 are fastened to the face panels 2, 3 in reverse with the edge 21 of the end panels 18, 19 adjacent edges 4, 5 of face panel 2, and edge 20 of end panels 18, 19 adjacent edges 4, 5 of the face panel 3.

The connections between the face panels 2, 3 and the end panels 18, 19, through the third and fourth connections 129, 130 and the fasteners 131 leave the side edges 4 of both face panels 2, 3 closely adjacent to and extending along parallel axes with respect to the side edges 20, 21 of the first end panel 18, and leave the opposite side edges 5 of both face panels 2, 3 closely adjacent the side edges 20, 21 of the second end panel 19. The curved end sections 31, 33 of the face panels 2, 3 and the curved end sections 79 of the end panels 18, 19 also provide at least partly rounded corners 135 on the post. The end panels 18, 19 can be provided with centrally located, inwardly directed slots 137 for connecting folding door panels to the post as is well known.

The face panels 2, 3 are preferably attached to each spacer 9 at the same end 15 of the spacer as shown in FIG. 3. This provides room at the other end 17 of the spacer for mounting elements of a lock mechanism if needed. The fasteners 131 connecting the end panels 18, 19 to the face panels 2, 3 are on the same side 13 of the spacers 9, that side being the side that faces into the area closed by the closure so that that the fasteners 131 are not accessible outside the closure.

The post has been provided with face panels 2, 3 that have a central groove 29. The panels can have the groove 29 covered with a panel section (not shown) joining the side sections 31, 33 together to provide a post with a smooth outer contour while still having the face panels 2, 3 mounted against the sides of the spacers via the central area 23. However, in a particular embodiment, the grooves 29 provide several advantages to the post. The sidewalls 25, 27 of the grooves provide handles on both sides of the post which can be gripped anywhere along the length of the post to pull the post in either direction to open or close the closure associated with the post. The grooves 29 also provides a recess in which any visible lock mechanism(s) such as lock cylinders or panic handles can be mounted to protect them from damage and also to protect passer-boys from coming in contact with them. The grooves also provide a clean, distinctive appearance for the post.

The post has a standard post lock mechanism (not shown) mounted therein. The post is provided, as shown in FIG. 1, with an opening 141 in the end wall 18 of the post which end wall is not attached to the closure associated with the post. The opening 141 is located opposite the lock mechanism in the post. The opening 141 is shaped and sized to allow the lock latch of the locking mechanism to pass out of the opening in a manner to lock the post to another post or to the side of an opening to be closed by the closure carrying the post. The post can also be provided with an opening 143 in the central section 23 of one of the grooves 29 opposite the lock mechanism to permit a lock cylinder of the locking mechanism to be partly located in the groove where it is accessible to be operated by a key and protected by the side walls of the groove.

In a particular embodiment, the locking post is much simpler and cheaper to construct than prior posts of unitary tubular construction, and/or is configured such that it is much simpler and easier to mount locking mechanisms thereto. In a particular embodiment, the mounting post holds locking mechanisms and can be more easily serviced than prior posts of unitary tubular construction. In a particular embodiment, the locking post advantageously provides integral handles and/or protects elements projecting from the surfaces of the post.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, such modifications are intended to fall within the appended claims.

The invention claimed is:

1. A locking post for a folding door having: two separate face panels, each face panel having two side edges extending along parallel axes; two separate end panels, each end panel having two side edges extending along parallel axes; a plurality of spaced-apart spacers including a spacer at least near each end of the post; the spacers having opposed parallel sides; a first fastener fastening each face panel to each spacer, one of the face panels extending on one side of each spacer; the other of the face panels extending on the opposed side of each spacer, the face panels parallel and aligned; one side of one end panel detachably connected to one side of one face panel and a second fastener detachably fastening the other side of the one end panel to one side of the other face panel; and one side of the other end panel detachably connected to the other side of the one face panel and a second fastener detachably fastening the other side of the other end panel to the other side of the other face panel, the end panels parallel.

2. A locking post as claimed in claim 1 wherein a first connection is defined for each of the first and second face panels between one end of each spacer and one side of the face panel, and a second connection is defined for each of the first and second face panels between the other end of each spacer and the other side of the face panel, the first and second connections for the first face panel being on the one side of each spacer, the first and second connections for the second face panel being on the other side of each spacer.

3. A locking post as claimed in claim 2 wherein the first fasteners fasten together the second connections between each spacer and the first face panel and between each spacer and the second face panel.

4. A locking post as claimed in claim 1 wherein one of the end panels overlies the first fastener.

5. A locking post as claimed in claim 1 wherein each face panel has a central groove extending along the length of the panel, the groove having a central bottom section joined at its sides to the rest of the face panel by sidewalls, the central bottom section abutting a side of each spacer.

6. A locking post as claimed in claim 5 one of the face panels having an opening in the central bottom section of the groove through which a lock mechanism for the post can project into the groove to be accessible.

7. A locking post as claimed in claim 1 one of the end panels having an opening through which a lock mechanism for the post can project when needed to lock the post.

8. A locking post for a folding door having: first and second separate face panels; first and second separate end panels; a plurality of spaced-apart spacers including a spacer at least near each end of the post, the spacers having opposed parallel sides; the first face panel attached to the spacers to be on one side of the spacers, the second face panel attached to the spacers to be on the other side of the spacers, the face panels parallel and aligned, the first end panel detachably attached to the two face panels at one side of the face panels, the second end panel detachably attached to the two face panels at their other side, the end panels parallel and aligned; a first connection defined for each of the first and second face panels between one end of each spacer and one side of the face panel, and a second connection defined for each of the first and second face panels between the other end of each spacer and the other side of the face panel, the first and second connections for the first face panel being on one side of each spacer and first and second connections for the second face panels being on the other side of each spacer; and first fasteners for fastening together the second connections between each spacer and the first face panel and between each spacer and the second face panel; the face panels and end panels together providing a tubular enclosure for the spacers.

9. A locking post for a folding door having: first and second separate face panels; first and second separate end panels; a plurality of spaced-apart spacers including a spacer at least near each end of the post, the spacers having opposed parallel sides; the first face panel attached to the spacers to be on one side of the spacers, the second face panel attached to the spacers to be on the other side of the spacers, the face panels parallel and aligned, the first end panel detachably attached to the two face panels at one side of the face panels, the second end panel detachably attached to the two face panels at their other side, the end panels parallel and aligned; a first connection defined for each of the first and second face panels between one end of each spacer and one side of the face panel, and a second connection defined for each of the first and second face panels between the other end of each spacer and the other side of the face panel, the first end second connections for the first face panel being on one side of each spacer and first and second connections for the second face panels being on the other side of each spacer; and first fasteners for fastening together the second connections between each spacer and the first face panel and between each spacer and the second face panel; a third connection is defined for each of the first and second end panels between one side of the end panel and the respective side of the first face panel, and a fourth connection is defined for each of the first and second end panels between the other side of the end panel and the respective side of the second face panel; second fasteners for detachably connecting together the fourth connections between the first end panel and the second face panel and between the second end panel and the second face panel; the face panels and end panels together providing a tubular enclosure for the spacers.

10. A locking post as claimed in claim 8 wherein one of the end panels overlies the first fasteners.

* * * * *